US006679959B2

(12) United States Patent
Boyd et al.

(10) Patent No.: US 6,679,959 B2
(45) Date of Patent: Jan. 20, 2004

(54) PROPELLANT

(75) Inventors: Durrell Boyd, King George, VA (US); Ray Bazil, Waldorf, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 142 days.

(21) Appl. No.: 09/767,297

(22) Filed: Dec. 18, 2000

(65) Prior Publication Data

US 2003/0041935 A1 Mar. 6, 2003

(51) Int. Cl.[7] ..... C06B 45/10
(52) U.S. Cl. ..... 149/19.1
(58) Field of Search ..... 149/19.9, 19.4, 149/19.1

(56) References Cited

U.S. PATENT DOCUMENTS 3,948,698 A 4/1976 Elrick et al. ..... 149/19.6
3,982,975 A 9/1976 Elrick et al. ..... 149/19.9
3,984,265 A 10/1976 Elrick et al. ..... 149/19.9
4,241,661 A 12/1980 Elrick et al. ..... 102/103
4,375,522 A 3/1983 Braun ..... 523/180
4,882,994 A 11/1989 Veltman et al. ..... 102/290
6,036,894 A * 3/2000 Brown et al. ..... 264/3.1
6,086,692 A 7/2000 Hawkins et al. ..... 149/19.9

* cited by examiner

*Primary Examiner*—John Hardee
(74) *Attorney, Agent, or Firm*—Mark Homer

(57) ABSTRACT

Compositions of matter for use as propellants, methods of making these compositions, and devices incorporating the compositions, are described. One composition of the invention includes ammonium perchlorate, iron oxide, finely divided silica and a crosslinkable binder. Another general composition of the invention includes ammonium perchlorate, iron oxide, finely divided silica and a crosslinked binder.

3 Claims, 3 Drawing Sheets

PRIOR ART

PRIOR ART

PROPELLANT

BACKGROUND OF THE INVENTION

1. Field of the Invention

The present invention relates to field of explosive and thermic compositions, in particular to propellants, and more particularly to solid propellants.

2. Description of the Related Art

Solid propellants, that is solid compositions which can rapidly generate gas for propulsion purposes, have a variety of uses. For example, solid propellants are commonly used in rocket motors and in applications such as automotive airbags.

One area of particular interest for the use of solid propellants is closed breech propulsion systems. In closed breech propulsion systems, the propellant gas is generated in a closed chamber to effect the propulsion, rather than being vented as in a rocket motor. Closed breech systems are used, for example, in gun systems, catapults, and aircraft ejections seats.

One aspect of closed breech propulsion systems is that, during gas generation, the pressure of the gas builds in the closed chamber. The gas pressure affects the burn rate of the propellant, and this dependency can be an important operating parameter of the propellant. It is conventional in the art to determine the burn rate of the propellant, typically measured in inches per second (in/sec) as a function of the pressure, typically measured in pounds per square inch (psi). The logarithm of the burn rate of the propellant is typically plotted against the logarithm of the pressure in a burning rate plot, and the slope of such a log—log plot, that is, the change in logarithm of burn rate divided by change in logarithm of pressure, is called the pressure exponent.

A common phenomenon seen with many propellants is a sharp increase in pressure exponent in the region 4000–6000 psi, this increase being known as the "slope break". This slope break is undesirable in many applications. For example, in aircrew escape systems, such as ejector seats, a closed breech system is used in which the propellant must operate at very high pressures in order to exert a large amount of energy over a short but controlled time frame. The pressure in such systems is strongly affected by the weight of the aircrew member to be ejected, however, and it is desirable to be able to exert less force on lighter pilots than on heavier pilots, so that lighter pilots do not experience excessive G-forces. An ideal system should be able to accommodate a broad range of weights of aircrew members. In order to achieve the desired high pressure and accommodate the range of weights, it is desirable that the slope break be minimized in the useful pressure range.

Another parameter of interest in propellant systems is the temperature sensitivity of the burning rate. This is of particular concern whenever the propellant may be used at a variety of ambient temperatures and a precise control over the burning rate is desirable. Again, this is commonly the case in military applications.

U.S. Pat. No. 3,948,698, to Elrick et al., entitled *SOLID PROPELLANT COMPOSITIONS HAVING EPOXY CURED, CARBOXY-TERMINATED RUBBER BINDER,* describes propellant compositions having epoxide-cured carboxy terminated rubber and other ingredients including aluminum, ammonium perchlorate, and iron oxide.

U.S. Pat. No. 3,982,975, to Elrick et al., entitled *PROPELLANTS HAVING IMPROVED RESISTANCE TO OXIDATIVE HARDENING,* describes propellant compositions with components including aluminum, ammonium perchlorate, carboxylated polybutadiene.

U.S. Pat. No. 3,984,265, to Elrick et al., entitled *COMPOSITE PROPELLANTS HAVING IMPROVED RESISTANCE TO THERMAL OXIDATION,* describes propellant compositions with components including aluminum, ammonium perchlorate, $Fe_2O_3$, and carboxylated polybutadiene, a curing agent, and other ingredients including fillers such as carbon black and silica.

U.S. Pat. No. 4,241,661, to Elrick et al., entitled *COMPOSITE PROPELLANT WITH SURFACE HAVING IMPROVED STRAIN CAPACITY,* describes propellant compositions having components including ammonium perchlorate, aluminum, iron oxide and carboxy terminated polybutadiene, as well as additional agents including an antioxidant.

U.S. Pat. No. 4,375,522, to Braun, *entitled THIXOTROPIC RESTRICTOR, CURABLE AT ROOM TEMPERATURE, FOR USE ON SOLID PROPELLANT GRAINS*, describes a solid propellant restrictor containing hydroxyl-terminated polybutadiene, carbon black, silica and other ingredients. The restrictor is designed for use in the MK56 rocket motor which employs a solid propellant grain consisting of aluminum, ammonium perchlorate and diisocyanate-cured hydroxyl-terminated polybutadiene.

U.S. Pat. No. 4,882,994, to Veltman et al., entitled *PARTICULATE FUEL COMPONENTS FOR SOLID PROPELLANT SYSTEMS,* describes a propellant component based on a polybutadiene-styrene latex, which contains aluminum and silica. Propellants using this component and containing ingredients including ammonium perchlorate and hydroxyl-terminated polybutadiene binder are also described.

U.S. Pat. No. 6,086,692, to Hawkins et al., entitled *ADVANCED DESIGNS FOR HIGH PRESSURE HIGH PERFORMANCE SOLID PROPELLANT ROCKET MOTORS*, discusses solid rocket propellant formulations with a burn rate slope which indicates a substantially insensitive burn rate over a substantial portion of the pressure range. This formulation include ingredients including ammonium perchlorate, a polyalkylene oxide binder, aluminum fuel, ballistic modifier which may be silica, and other components.

Two other compositions currently in use are that used in the M270 impulse cartridge and the CCU22 propellant composition, and their compositions are summarized in Tables 1 and 2. The burn rate profiles of the M270 and CCU22 compositions show substantial slope breaks, however.

TABLE I

Propellant Composition of CCU22

| Ingredient | % |
|---|---|
| Carboxyl - Terminated Polybutadiene (CTPB) | 16.20 |
| Aluminum | 2.00 |
| Iron Oxide ($Fe_2O_3$) | 1.80 |
| Ammonium Perchlorate, 200$\mu$ | 24.50 |
| Ammonium Perchlorate, 40$\mu$ | 55.50 |

TABLE II

| Propellant Composition of M270 | |
|---|---|
| Ingredient | % |
| Carboxyl - Terminated Polybutadiene (CTPB) | 15.55 |
| Aluminum | 1.50 |
| Iron Oxide ($Fe_2O_3$) | 1.75 |
| Titanium Dioxide ($TiO_2$) | 2.50 |
| Ammonium Perchlorate, 200$\mu$ | 42.30 |
| Ammonium Perchlorate, 45$\mu$ | 36.40 |

SUMMARY OF THE INVENTION

It is therefore an object of the present invention to provide an improved solid propellant.

A further object of the invention is to provide an improved propellant for use in closed breech applications.

A yet further object of the invention is to provide a propellant with improved slope break characteristics.

A still further object of the invention is to provide a propellant with lower temperature sensitivity of the burn rate.

Another object of the invention is to provide an improved propellant for use in aircrew escape systems.

These and other objects are provided by the present invention, which includes compositions of matter for use as propellants, methods of making these compositions, and devices incorporating the compositions.

One embodiment of the invention is a composition which includes ammonium perchlorate, iron oxide, finely divided silica and a crosslinkable binder. Another embodiment is a composition which includes ammonium perchlorate, iron oxide, finely divided silica and a crosslinked binder, which may be crosslinked by use of a curing agent. Other components which may be included in the compositions of the invention include powdered carbon, powdered aluminum, plasticizers, bonding agents and antioxidants.

BRIEF DESCRIPTION OF THE DRAWINGS

A more complete appreciation of the invention, and may of the attendant advantages, thereof, will be readily apparent as the same becomes better understood by reference to the following detailed description when considered in conjunction with the accompanying drawings in which like reference symbols indicate the same or similar components, wherein.

DETAILED DESCRIPTION OF THE INVENTION

Figure 1:
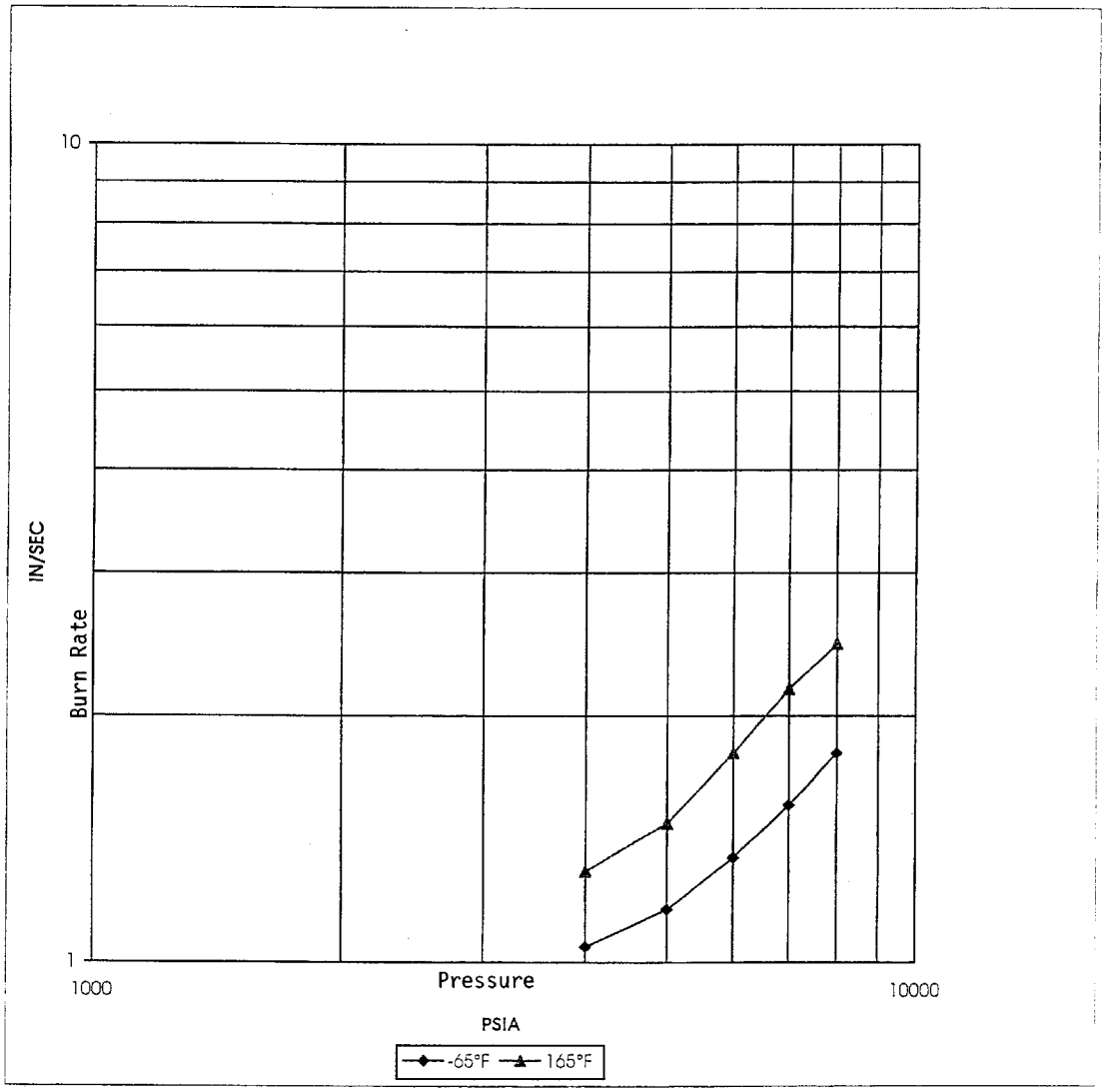
FIG. 1 is a burning rate curve for propellant CCU-22.

The present invention encompasses solid propellant compositions, methods of making the solid propellant compositions, and devices incorporating the solid propellant compositions. As will be described, solid propellant compositions may contain a variety of components for a variety of purposes. Also, as will be described, solid propellants are generally subjected to a curing or polymerization process during manufacture, leading to a cured product. Thus, at least one of the components used in manufacture of a solid propellant is chemically altered in the finished propellant.

In a general embodiment of the invention, the invention is a composition including ammonium perchlorate, iron oxide ($Fe_2O_3$), finely divided silica and a crosslinkable binder. Here, iron oxide will refer to $Fe_2O_3$, which is ferric oxide. Iron oxide red, also known as burnt sienna, rouge and by other terms, is commonly used form of iron oxide.

In the present invention, finely divided silica will refer to silica of fine particle size and high surface area. Suitable for the present invention is colloidal silica such as fumed silica. Commercial colloidal silicas, such as Cab-O-Sil (tm), may be used in the invention.

"Binder" is a term generally used in the art for a material which serves to bind a composition together, that is, to hold it in a particular shape. Binders are generally plastic or thermoplastic resins. In the present invention, the binder is a crosslinkable compound, that is, the binder molecules can be chemically crosslinked, in a curing process, to other binder molecules to form a larger molecular weight species with a structure which provides the binding property. Many such binders are known in the art. Examples include hydroxyl-terminated polybutadiene (HTPB), carboxy-terminated polybutadiene (CTPB), carboxy-terminated polybutadiene acrylonitrile (CTBN) and hydroxyl-terminated polyether (HTPE). Although the binder serves to bind the composition together, this need not be the binder's only function. For example, the binder may also serve as a fuel, to be burnt by the oxidant in the propellant.

In another embodiment of the present invention, the invention may be considered to be a composition including ammonium perchlorate, iron oxide, finely divided silica and a cross-linked binder. This composition generally results from chemical cross-linking of the binder of the composition described above. This cross-linking maybe achieved by addition of an additional curing agent which chemically reacts with the cross-linkable binder. Many such systems are known in the art. For example, hydroxyl-terminated binders may be cross-linked by use of diisocyanates or triisocyanates. A typical example is the use of isophorone diisocyanate (IPDI) with hydroxyl-terminated polybutadiene. Other examples include the use of epoxide-cured carboxy-terminated polybutadiene.

In the above embodiments of the invention, the compositions will typically be made using ammonium perchlorate in particulate form. The particle size of the ammonium perchlorate can affect manufacturing and performance properties of the final composition. As it is difficult to characterize the particle size of ammonium perchlorate in the final composition, the compositions can be characterized by the particle size of ammonium perchlorate used to make the composition. The particle size of ammonium perchlorate can be measured by Microtrac, and the particle size distribution of a sample may be expressed as the fraction of the particles, by weight, below a specific size. In one embodiment of the present invention, for example, 70% of the ammonium perchlorate is in particles less than 55$\mu$. In another embodiment, 99% of the ammonium perchlorate particles are less than 55$\mu$.

In one embodiment of the invention, the silica may be present at 0.25 to 2.0% of the overall composition. In another embodiment, silica may be present at 0.25 to 1.0%.

In one embodiment of the invention, the iron oxide may be present at 0.5 to 2.0%.

Additional components may also be included in the invention. In another embodiment, for example, the general compositions described above may also contain aluminum. The aluminum will generally be included as powdered metal, and may serve as a fuel for the propellant. In a particular embodiment, the aluminum is present in the range of 1 to 23% of the overall composition by weight.

Powdered carbon may also be included in embodiments of the invention. Here, powdered carbon refers to any finely divided form of carbon, including the various types of carbon black as well as charcoal. In a particular embodiment, the powdered carbon may be present at less than 2% by weight of the overall composition. The powdered carbon may serve the function of opacifier or ballistic modifier.

An antioxidant may also be included in embodiments of the invention. Antioxidants are compounds which serve the general purpose of inhibiting oxidative hardening of the binder, thereby slowing aging of the composition. Many compounds are known in the art to serve as antioxidants in propellants.

Embodiments of the invention may also include a plasticizer. Plasticizers generally affect the Theological characteristics of the final product. An example of a plasticizer is dioctyladipate.

Another embodiment of the invention includes a bonding agent. The bonding agent is generally an organic amine, and functions to form an amine salt on the surface of particles of ammonium perchlorate in the composition. In preparation of the composition, the bonding agent is typically introduced mixed with the binder, as will be discussed in detail below.

The process of making the compositions of the invention will now be described. In a basic embodiment of the process, the process involves preparing a composition including ammonium perchlorate, iron oxide, silica, a cross-linkable binder and a curing agent for cross-linking the binder.

This composition is then mixed until homogeneous. Mixing may be achieved by any of a variety of methods well known in the art. Then, the mixed composition is cast into a mold or container for curing. The process may also include a step of heating the composition after casting in the mold to accelerate the cross-linking of the binder.

In other embodiments of the process of the invention, the prepared composition before mixing may also include additional components as described above. That is, the composition may include components such as aluminum, an antioxidant, a plasticizer, or a bonding agent.

Typically, the step of preparing the composition as described above will include the step of preparing a composition of all of the ingredients except the ammonium perchlorate. The ammonium perchlorate is then added as the last component before mixing. In a particular embodiment of the process, the ammonium perchlorate is added in at least two steps. The ammonium perchlorate particles of size greater than 55$\mu$ are added first and the composition is mixed. Then the ammonium perchlorate particles of size less than 55$\mu$ are added and the composition is further mixed. As described above, in one embodiment of the present invention, 70% of the total ammonium perchlorate is added in the form of particles less than 55$\mu$. In another embodiment of the process, 99% of the ammonium perchlorate particles are less than 55$\mu$.

In one embodiment of the invention, the binder is mixed with bonding agent before being added to the prepared composition described above.

EXAMPLE 1

An actual formulation example of the present invention which has been prepared and tested will now be described. The main components of the composition of the formulation of Example 1 are shown in Table III. The process for making this formulation is as follows:

TABLE III

Propellant Formulation of Example 1

| Ingredient | % |
|---|---|
| Hydroxyl - Terminated Polybutadiene (HTPB) | 17.55 |
| Aluminum Powder | 2.00 |
| Carbon Black | 0.10 |
| Silicon Dioxide | 0.50 |
| Iron Oxide | 1.50 |
| Ammonium Parchlorate, 200$\mu$ | 23.50 |
| Ammonium Perchlorate, 45$\mu$–55$\mu$ | 54.85 |

1. Ammonium perchlorate is ground on a micropulverizer to a 50% by weight measurement in the range of 45 to 55$\mu$ as measured by Microtrac, to create a fine fraction. Ammonium perchlorate of 200$\mu$ is considered a coarse fraction.

2. The hydroxyl-terminated polybutadiene binder, aluminum, carbon black, silicon dioxide, and iron oxide, as shown in Table 3, are placed in a mixer under vacuum. The polybutadiene binder contains a bonding agent and an antioxidant is also added. These ingredients are mixed under vacuum at elevated temperatures.

3. The coarse, 200$\mu$, fraction of ammonium perchlorate is added in multiple additions with mixing under vacuum at elevated temperature after each addition.

4. The fine fraction of ammonium perchlorate is added in multiple additions with mixing under vacuum at elevated temperature after each addition.

5. Isophorone diisocyanate is added as a curing agent is added and the mixed under vacuum at elevated temperature.

6. The mixture is vacuum cast into an appropriate vessel and cured at elevated temperature.

Figure 2:
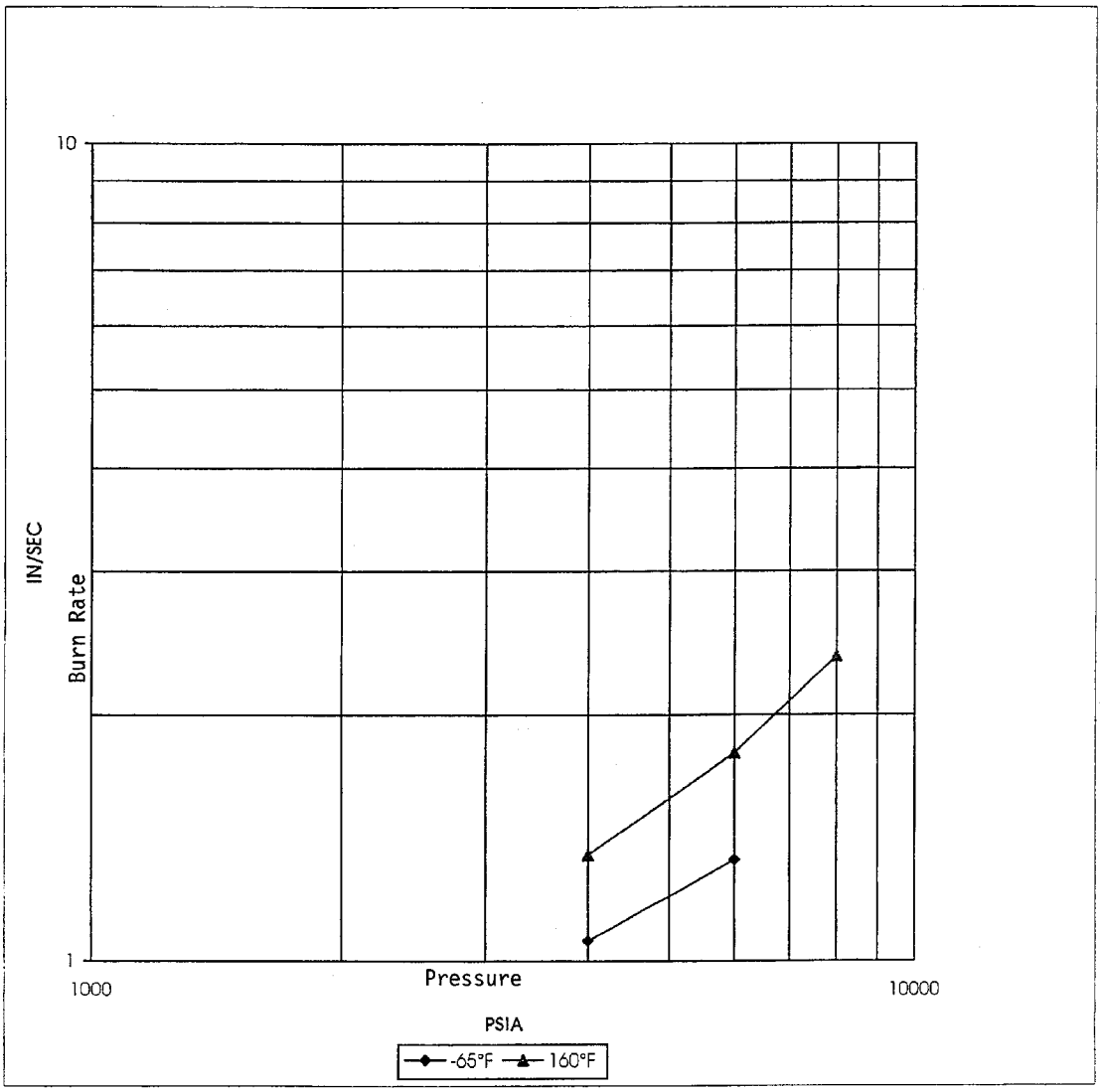
FIG. 2 is a burning rate curve for propellant M270
Figure 3:
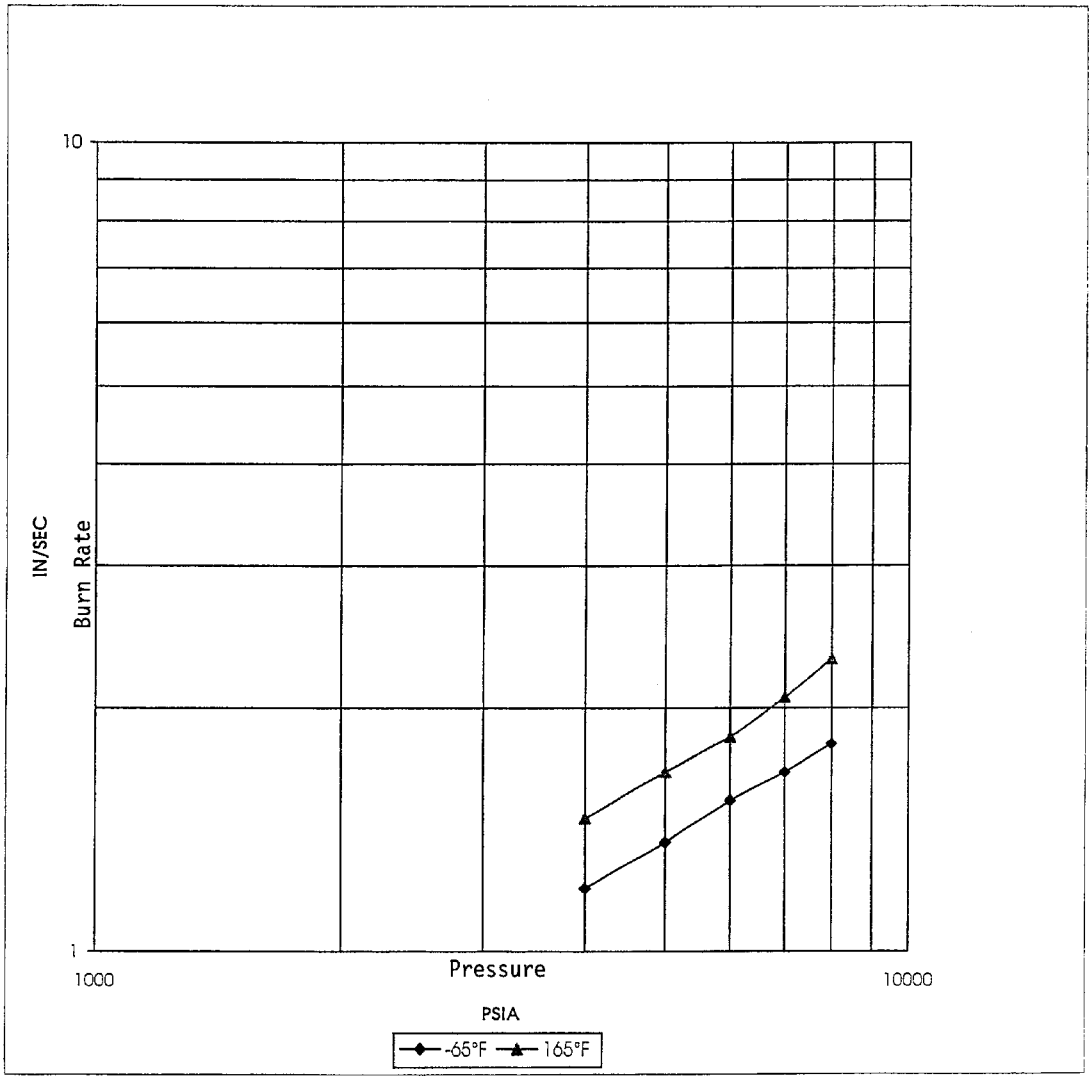
FIG. 3 is a burning rate curve for the composition of Example 1 of the present invention.

The burning rate curve was measured for the resulting propellant. FIGS. 1 and 2 illustrate the burning rate curve for comparison compositions CCU-22 and M270. FIG. 3 illustrates the burning rate curve of Example 1, and Table IV summarizes properties of these propellants. It can be seen that the properties of the propellant of the invention, Example 1, are different from those of comparison examples CCU-22 and M270. Of particular interest in the properties of Example 1 are the surprisingly low values of pressure exponent and of burning rate sensitivity to temperature.

TABLE IV

Propellant Burning Rate Comparisons

| Propellant Formulation | Example 1 | CCU-22 | M270 |
|---|---|---|---|
| Burning Rate @ 4000 psi, 165° F., in/sec | 1.458 | 1.291 | 1.348 |
| Burning Rate @ 6000 psi, 165° F., in/sec | 1.838 | 1.803 | 1.796 |
| Burning Rate @ 8000 psi, 165° F., in/sec | 2.299 | 2.453 | 2.361 |
| Pressure Exponent, n 4000–6000 psi | 0.570 | 0.820 | 0.710 |
| Pressure Exponent, n 6000–8000 psi | 0.780 | 1.070 | 0.950 |
| Burning Rate Sensitivity to temperature, $\sigma_P$ 4000 psi, −65° F. to 165° F., %/° F. | 0.085 | 0.092 | 0.140 |
| Burning Rate Sensitivity to temperature, $\sigma_P$ 6000 psi, −65° F. to 165° F., %/° F. | 0.078 | 0.127 | 0.130 |
| Burning Rate Sensitivity to temperature, $\sigma_P$ 8000 psi, −65° F. to 165° F., %/° F. | 0.106 | 0.133 | N/A |

The values of pressure exponent for Example 1 at 4000–6000 and 6000–8000 psi, respectively, are 0.570 and 0.780, compared to 0.820 and 1.070, respectively for CCU-22, and 0.710 and 0.950, respectively, for M270. The present invention therefore can yield compositions characterized in having an average pressure exponent of less than 0.600 over the range of 4000 to 6000 psi, and of less than 0.800 over the range of 6000 to 8000 psi.

The values of burning rate sensitivity to temperature over the range of −65° F. to 165° F. for Example 1 at 4000, 6000 and 8000 psi may be seen to be 0.085, 0.078 and 0.106, respectively, compared to 0.092, 0.127 and 0.133, respectively, for CCU-22 and 0.104 and 0.130 at 4000 and 6000 psi for M270. The present invention therefore can yield compositions characterized in having a burning rate sensitivity of less than 0.100 at 4000 psi, less than 0.100 at 6000 psi and less than 0.110 at 8000 psi.

The present invention may be used in a variety of devices employing propellants, including both rocket motors and closed breech propellant systems. A typical rocket motor using the present invention would have a rocket motor casing and a rocket nozzle, with the propellant of the invention installed in the rocket motor casing.

A closed breech propellant device of the invention would have a closed breech chamber, and would have the propellant of the invention installed in the closed breech chamber. When used in an ejection seat system of an aircraft, the device would also include an aircraft seat attached to the closed breech chamber.

The foregoing detailed description of the invention has been provided for the purposes of illustration and description of the invention, but the invention is not to be taken to be limited to the precise embodiments disclosed. Many modifications and variations will be apparent to practitioners skilled in the art. It is intended that the scope of the invention by defined by the following claims and their equivalents.

What is claimed is:

1. An improved propellant composition for operating at high pressures including ammonium perchlorate, iron oxide, a crosslinked binder and a containment device wherein the improved propellant composition operates in a region of 4000 psi or greater, wherein the improvement comprises:

finely divided silica, wherein the propellant composition comprises a pressure exponent of less than 0.600 at 4000 psi to 6000 psi, and comprises a pressure exponent of less than 0.800 at 6000 psi to 8000 psi.

2. The improved propellant composition of claim 1, further comprising a burn rate sensitivity over the range of −65° F. to 165° F. of less than 0.100 at 4000 Psi to 6000 psi and comprising a burn rate sensitivity over the range of −65° F. to 165° F. of less than 0.110 at 8000 Psi.

3. The improved propellant composition of claim 2, further comprising powdered carbon.

* * * * *